US005117895A

United States Patent [19]

Hargassner et al.

[11] Patent Number: 5,117,895

[45] Date of Patent: Jun. 2, 1992

[54] CONTINUOUS CASTING MOLD ARRANGEMENT

[75] Inventors: Reinhard Hargassner, Linz; Rudolf Scheidl, Erlauf; Helmut Holl, Hartkirchen, all of Austria

[73] Assignee: Voest-Alpine Industrieanlagenbau Gesellschaft m.b.H., Austria

[21] Appl. No.: 501,417

[22] Filed: Mar. 28, 1990

Related U.S. Application Data

[63] Continuation of Ser. No. 284,177, Dec. 14, 1988, abandoned.

[30] Foreign Application Priority Data

Dec. 23, 1987 [AT] Austria ..... 3414/87

[51] Int. Cl.[5] ..... B22D 11/124

[52] U.S. Cl. ..... 164/443; 164/485

[58] Field of Search ..... 164/443, 485

[56] References Cited

U.S. PATENT DOCUMENTS

| | | | |
|---|---|---|---|
| 3,595,302 | 7/1971 | Mallener | 164/443 |
| 3,667,534 | 6/1972 | Kanokogi et al. | 164/443 |
| 3,763,920 | 10/1973 | Auman et al. | 164/443 |
| 3,866,664 | 2/1975 | Auman et al. | 164/443 |
| 4,040,467 | 8/1977 | Alberny et al. | 164/443 |

OTHER PUBLICATIONS

Nippon Kokan Technical Report, Overseas No. 48, (1987), The Operation of Hot Direct Rolling of Kukuyama Works, pp. 1-9.

*Primary Examiner*—Richard K. Seidel
*Assistant Examiner*—Edward A. Brown
*Attorney, Agent, or Firm*—Handal & Morofsky

[57] ABSTRACT

With a continuous casting mold, the mold side walls each are formed by a supporting wall and an internal plate fastened thereto and getting into contact with the metal melt. On the side of the internal plate facing the supporting wall parallely arranged coolant channels are provided, which are designed as slits open towards the supporting wall and whose width is smaller and whose depth is larger, than the width of the ribs located between the slits. In order to render the cooling performance particularly effective, the width of the cooling ribs is smaller than, or equal to, 13 mm and the flow speed of the coolant is adjusted such that the heat transmission coefficient alpha between the internal plate and the coolant is between 20 and 70 $kW/m^2K$, preferably between 25 and 50 $KW/m^2K$, such that the heat flow density for the internal plate is larger than the heat flow density for a smooth internal plate having no ribs.

7 Claims, 3 Drawing Sheets

FIG. 1
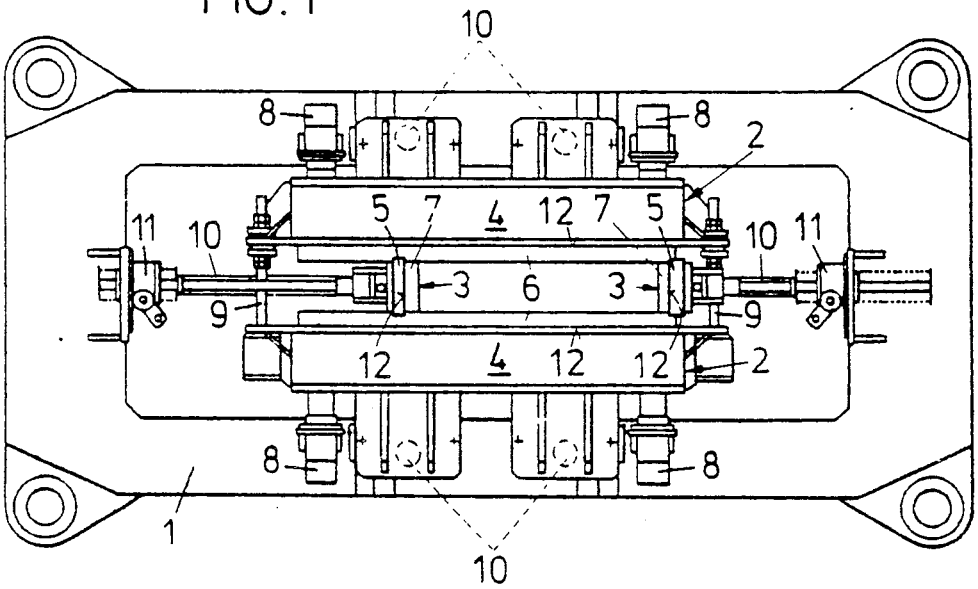
FIG. 5
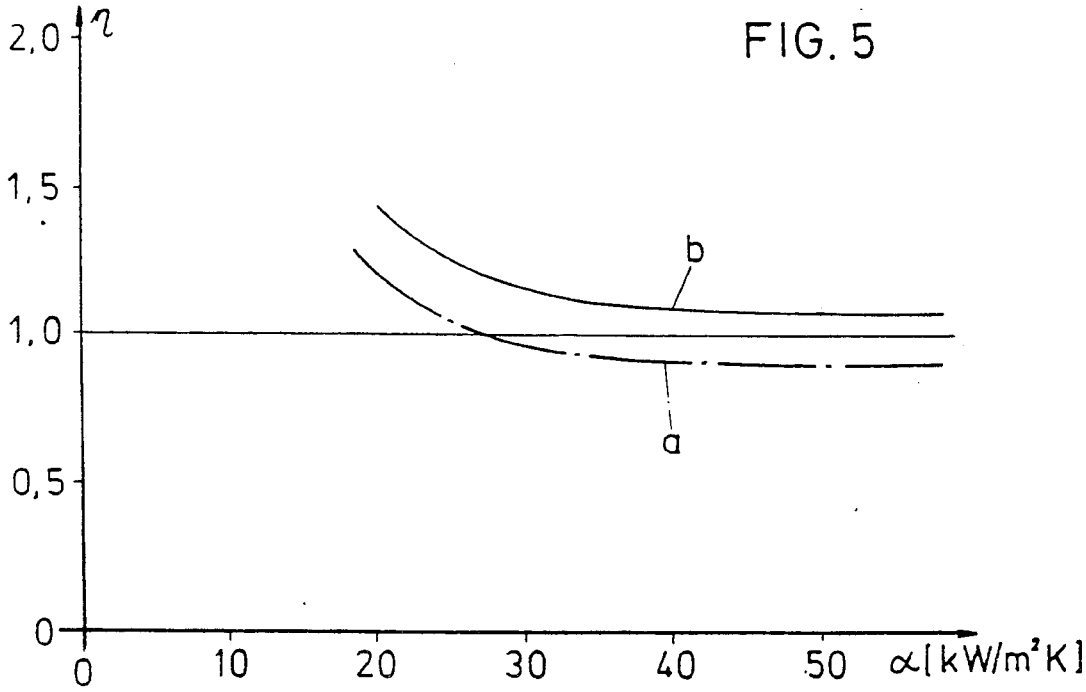
FIG. 6
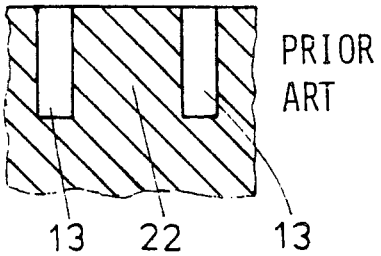
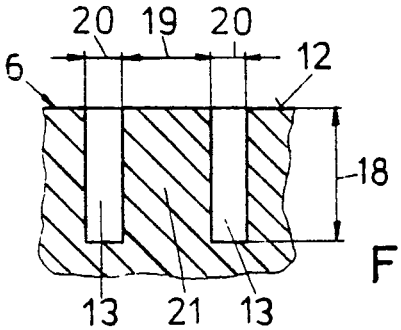
FIG. 7

FIG. 3
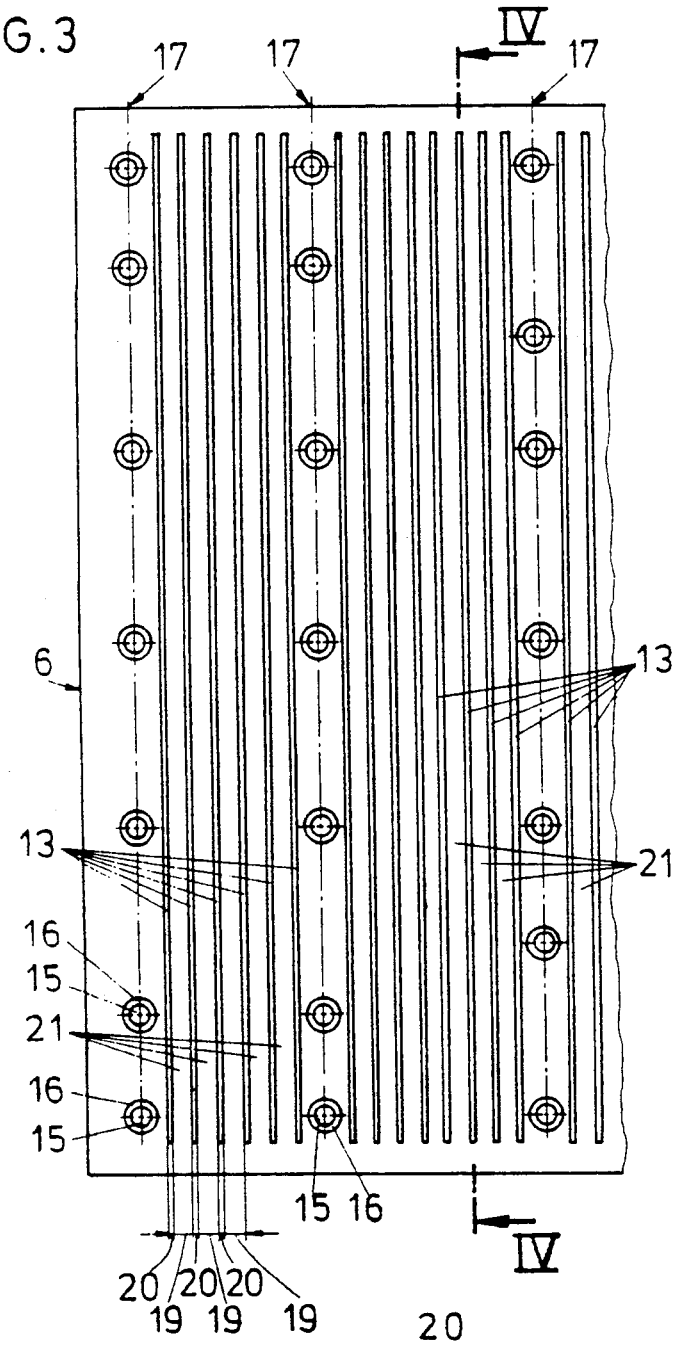
FIG. 4
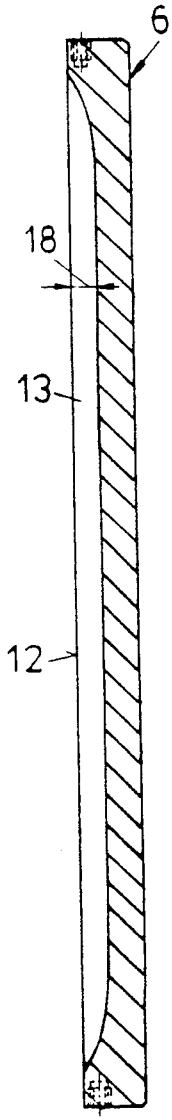
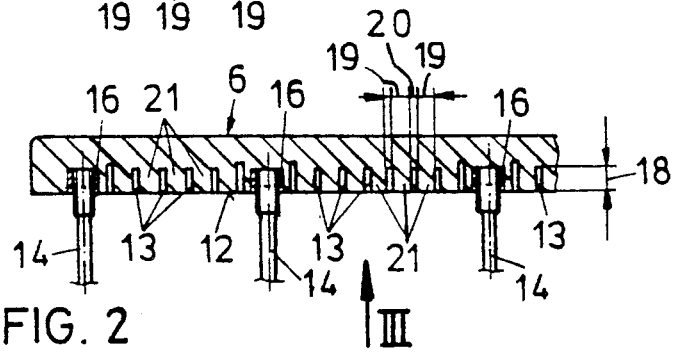
FIG. 2

CONTINUOUS CASTING MOLD ARRANGEMENT

CROSS-REFERENCE TO RELATED APPLICATION this application is a continuation of U.S. application Ser. No. 284,177, filed Dec. 14, 1988, now abandoned.

BACKGROUND OF THE INVENTION

The invention relates to a continuous casting mold, in particular a plate mold for continuously casting billets and blooms or slabs of steel, wherein the mold side walls are each formed by a supporting wall and an internal plate fastened thereto and getting into contact with the metal melt, and wherein on the side of the internal plate facing the supporting wall parallelly arranged coolant channels are provided, which are designed as slits open towards the supporting wall and whose width is smaller and whose depth is larger, than the width of the ribs located between the slits.

Continuous casting molds of this type (U.S. Pat. Nos. 3,866,664 and 3,763,920) are used to cast steel strands having slab or billet or bloom cross sections. In order to keep the temperature of the internal plates, which, as a rule, are made of copper or of a copper alloy, low even at high casting speeds, much emphasis has been laid on the intensive and uniform cooling of the internal plates.

With known continuous casting molds, the ribs provided between the coolant channels serve to keep the amount of coolant required per time unit low and to attain a high flow speed of the coolant. Moreover, it is possible, on account of the ribs, to keep the machining volume low at the manufacture of the internal plates.

From Nippon Kokan Technical Report, No. 48 (1987) it is known to provide 5 mm wide and 15 mm deep slits as coolant channels, at a distance of 20 mm. However, this embodiment allows for but little effective cooling so that one is forced to adjust a relatively high coolant speed in order to ensure an acceptable temperature of the internal plates, which, in turn, causes the efficiency to decrease.

SUMMARY OF THE INVENTION

The invention aims at avoiding this disadvantage and has as its object to provide a continuous casting mold of the initially defined kind, with which particularly effective cooling by means of a slight specific amount of coolant only and at not too high a coolant speed is feasible. In particular, only little volume is to be machined at the manufacture of the internal plates.

In accordance with the invention, this object is achieved in that the width of the cooling ribs is smaller than, or equal to, 13 mm and that the flow speed of the coolant is adjusted such that the heat transmission coefficient alpha between the internal plate and the coolant is between 20 and 70 $kW/m^2K$, preferably between 25 and 50 $kW/m^2K$, such that the heat flow density for the internal plate is larger than the heat flow density for a smooth internal plate having no ribs.

The invention is based on the finding that the ribs provided between the coolant channels are able to function as cooling ribs only if the ratio of the depth of a slit to the width of a cooling rib is larger than 1 and, in addition to this condition, if the heat transmission coefficient alpha lies within the margins indicated above. Hence results a coolant speed that is low as compared to the prior art, and which is at a relation to the heat transmission coefficient alpha of alpha $= c \cdot v_H{}^2 O^{0.85}$ such that an efficient heat emission is ensured without overheating the coolant. If the ratio of the depth of a slit to the width of a cooling rib is smaller than 1, the ribs will have an adverse influence on the cooling effect, i.e., cooling will be impaired by the ribs; in that case, a smooth-wall design of the rear side of the internal plates omitting the ribs would be more effective.

Investigations have proved that the heat flow density (the amount of heat carried away per time unit and area unit by a coolant flowing at a predetermined coolant speed) is larger for a smooth plate than for a plate of equal thickness to which prior art ribs have been molded. The ratio of the heat flow density of a plate equipped with ribs to the heat flow density of a smooth plate will become larger than 1 only if the ribs assume the function of "cooling ribs"i.e. if they intensify the cooling effect; and this the case only if specific ratios of geometric dimensions and a specific magnitude of the heat transmission coefficient alpha are observed. What is decisive in the first place is the maximum width of a rib.

Preferably, the width of a slit is between 3 and 7 mm and the ratio of the slit width to the rib width is one to two at the most. The dimensioning of the slits is important to the cooling function of the arrangement. Should the slit be too narrow, fouling produced by impurities can block coolant flow and therefore obstruct heat exchange. An overly wide slit is less efficient for heat exchange. Milling problems also are encountered cutting a thin slot and in cutting a wide slot the volume of material being machined may be problematic.

The invention will now be explained in more detail by way of two embodiments with reference to the accompanying drawings, wherein:

BRIEF DESCRIPTION OF THE DRAWINGS

FIG. 1 is a top view onto the mold in a schematic illustration;

FIG. 2 represents a cross sectional view through an internal plate on an enlarged scale;

FIG. 3 is a view of the internal plate in the direction of the arrow III of FIG. 2;

FIG. 4 illustrates a section along line IV—IV of FIG. 3;

FIG. 5 is a diagrammatic view of the dependency of the cooling efficiency on the heat transmission coefficient for the various internal plates shown in FIGS. 6 and 7, FIG. 6 being an embodiment according to the prior art, and FIG. 7 illustrating an embodiment according to the invention;

DESCRIPTION OF THE PREFERRED EMBODIMENT

Figure 8:
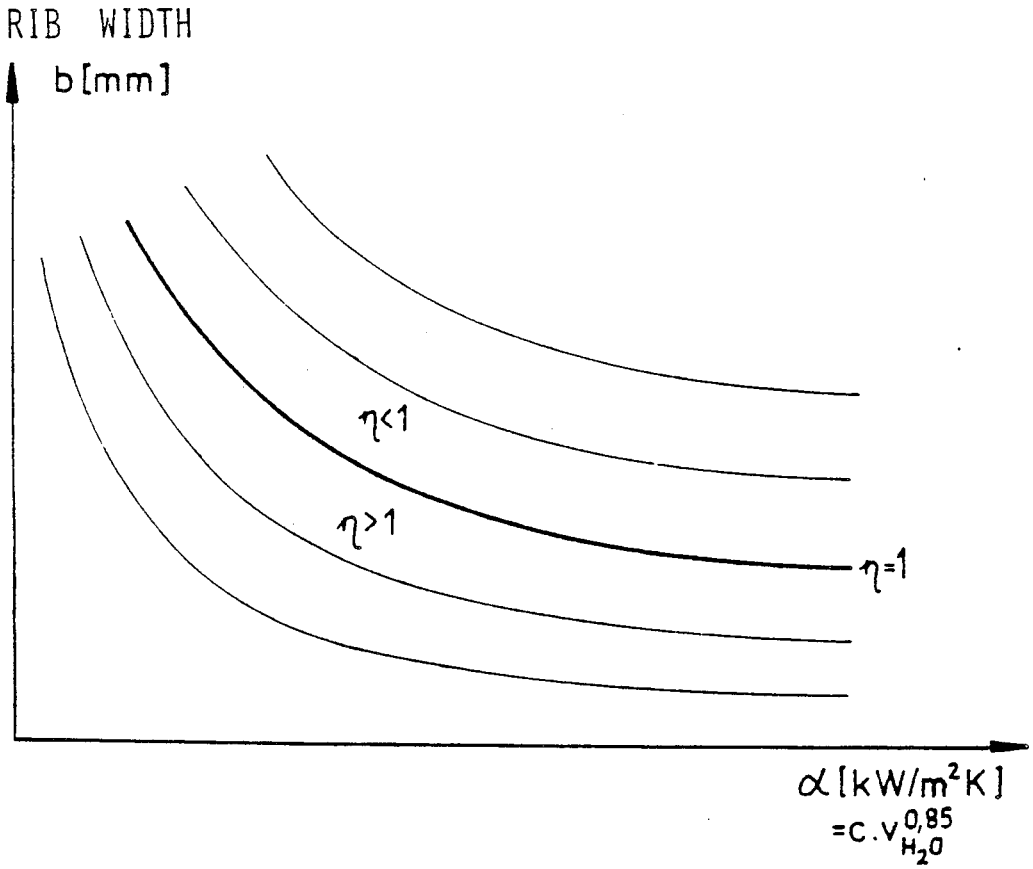
FIG. 8 shows the dependency of the efficiency on the rib width and on the heat transmission coefficient.

In a frame-shaped water box 1 of a plate mold used to cast steel strands having slab cross section, broad side walls 2 and end side walls 3 are arranged. The broad side walls 2 and the end side walls 3 each are formed by a supporting wall 4, 5 to which an internal plate 6, 7 is fastened, which latter gets into contact with the metal melt. For continuous casting, the internal plates 6, 7 for continuous casting, as a rule, are made of copper or a copper alloy.

The broad side walls 2 are displaceable towards and away from each other by adjustment drives 8 mounted to the water box 1, and may be fixed in various positions relative to each other by a fixing means 9 such that clamping of the end side walls 3 between the broad side walls or providing a gap of constant size between the broad side walls 2 and the end side walls 3 is feasible.

Both the broad side walls 2 and the end side walls 3 are connected to the water box 1 by means of cooling water supplies 10. Adjustment drives 11, which for instance, are comprised of threaded spindles and are connected to the upper or lower rim portion of each end side wall 3 serve to displace, and to adjust the inclination of, each end side wall 3.

The internal plates 6, 7 of the end and broad side walls 2, 3, on their rear sides 12, i.e., on the sides abutting on the respective supporting walls 4, 5, are provided with parallelly arranged coolant channels designed as slits 13 open towards the supporting walls 4, 5. The side walls delimiting the slits preferably are parallel to each other and preferably are oriented perpendicular to the plane of the internal plate. In order to prevent the internal plates 6, 7 from getting warped, they are rigidly fastened to the supporting walls 4, 5 by means of numerous clamping bolts 14. The bores 15 that serve to screw in the clamping bolts 14 and which, suitably, are formed by intermediate sleeves 16 inserted into the internal plates 6, 7, are arranged in parallel rows 17 as is apparent particularly from FIG. 3. The slits 13 conducting the coolant are provided between these rows 17 extending in the height direction of the mold.

The slits 13 are arranged in a manner that the ratio of the depth 18 of a slit 13 to the distance of two neighboring slits 13, i.e, the width 19 of the intermediately arranged ribs 21, is larger than 1 in the area regions between the hole rows 17. The slits 13 have a width 20 of 5 mm (preferably their width amounts to between 3 and 7 mm), the intermediately arranged ribs 21 are 11 mm and, in the end region adjacent one end of the internal plate 6 between two hole rows 17, are 12 mm wide. Their depth 18 is to be seen from FIGS. 2 and 4; it amounts to 18 mm. The overall thickness of the internal plates 6, 7 is 40 mm. The internal plates 6, 7 may be refinished by about 11 mm on the sides that get into contact with the metal melt.

In the embodiment illustrated, the bottom of the slits 13 is plane, yet it could also be semi-circular.

The slits 13 are passed by a coolant, the ribs 21 located between the slits 13 functioning as cooling ribs. This is explained in more detail with reference to FIG. 5, which represents a diagram, in which the efficiency eta 7 is plotted on the ordinate and the heat transmission coefficient alpha is plotted on the abscissa. The efficiency eta expresses the ratio of the heat flow density of a wall provided with slit-shaped coolant channels to the heat flow density of a smooth wall resulting when the ribs 21 formed by the slits 13 have been omitted.

For all etas smaller than 1, the ribs 21 do not function as cooling ribs, but there will occur a poorer cooling effect than with the smooth comparative wall, i.e., the ribs interfere with the heat transmission. If eta is larger than 1, cooling will be improved by the ribs 21 as compared to a smooth wall, which means that the ribs 21 function as cooling ribs on account of the cooling effect intensified by them.

In FIG. 5, the range of the heat transmission coefficient between 20 and 50 $kW/m^2K$, in particular, is illustrated in respect of two different embodiments of slits and cooling ribs. The dot-and-dash line a indicates the dependency of the efficiency eta on the heat transmission coefficient alpha between 20 and 50 $kW/m^2K$ in respect of the rib 22 illustrated in FIG. 6 (with which the ratio depth—15 mm—of the slit 13 to width—15 mm—of a rib 22 is 1). Eta is more than one only from a value alpha of less than 24. The rib 22 illustrated in FIG. 6, therefore, is effective as a cooling rib with very small heat transmission coefficients alpha and, thus, with low coolant speeds only. Yet, such a coolant speed would bring about only insufficient cooling of the internal plate and, therefore, must not be adjusted in practice.

The basic relationship between the width of a rib, the heat transmission coefficient alpha and, thus, the coolant speed $v_{H^2O}$ (which results from the relation alpha $=$constant . $v_{H^2O}^{0.85}$) and the efficiency eta is illustrated in FIG. 8.

It is apparent from FIG. 8 that, with a given rib width, the flow speed $v_{H^2O}$ of the coolant constitutes an important factor as to whether the rib does function as a "cooling rib" or not in a sense that the higher the coolant speed—which causes an increase in the amount of heat carried away, though—the poorer the efficiency eta.

By way of the following Table, this fact is explained with reference to the embodiments illustrated in FIGS. 6 and 7. In line I, the conventional plate construction illustrated in FIG. 6 is demonstrated, and in line II the plate construction according to FIG. 7 is demonstrated. In the Table, the efficiency eta both for a low and a high coolant speed $v_{H^2O}$, the value alpha and the value $alpha_{eff}$=alpha×eta are each indicated. It is apparent that, with the construction according to the invention, a lower coolant speed results with the same value for $alpha_{eff}$ of 50,000.

| | eta | alpha | $alpha_{eff}$ | $v_{H2O}$ | $delta_p$ [bar] |
|---|---|---|---|---|---|
| I (FIG. 6) | 1.244 | 20,000 | 24.887 | 3.32 | |
| | 0.929 | 53.845 | 50,000 | 10.63 | 0.89 |
| II (FIG. 7) | 1.426 | 20,000 | 28,520 | 3.34 | |
| | 1.083 | 46,150 | 50,000 | 8.92 | 0.62 |

From this Table it can be seen that, in order to adjust equally low temperatures at the internal plates illustrated in FIG. 6 and FIG. 7, a lower coolant speed $v_{H^2O}$ and, thus, a lower specific coolant amount, a slighter pressure loss $delta_p$ and a lower pump performance are necessary with the embodiment according to the invention (FIG. 7).

The curve b entered in a solid line represents the efficiency eta for different heat transmission coefficients alpha resulting at a cooling rib 21 according to FIG. 7. It is apparent that, with all the heat transmission numbers under consideration, this curve lies above the straight line eta=1 so that the cooling rib 21 illustrated in FIG. 7 acts as a cooling rib in any event, i.e., even with totally different coolant speeds. With the cooling rib illustrated in FIG. 7, the ratio of depth 18 of the slit 13 to width 19 of the rib 21 lies at 1.5.

It has proved that, with an internal plate 6, 7 provided with slits 13, the cooling effect can be increased relative to a smooth-wall internal plate in respect of the usual coolant amounts and coolant speeds, if the ratio of the height of the ribs and the depth 18 of the slits to the width 19 of the ribs 21 is larger than 1. The width 20 of the slits 13 usually is 5 mm, depending on manufacturing engineering conditions, i.e., on the power of the milling cutters that serve to make the slits 13, which latter may not be made too thin and may not exceed a certain width in order to keep the machining volume as low as possible.

What we claim is:

1. In a continuous casting mold arrangement for continuously casting steel, of the type including mold side wall means each comprising a supporting wall and an internal plate supported in a fixed position with respect to said supporting wall and adapted to be put into contact with metal melt, the improvement comprising a plurality of coolant channels defined in said internal plate on its side facing said supporting wall, said coolant channels being configured as slits open towards said supporting wall and adapted to let a coolant pass therethrough, said slits being defined between ribs, each of said ribs having a rib width, each of said slits having a slit width that is smaller than said rib width and a slit depth that is larger than said rib width, said rib width being at most 13 mm and means for supplying said coolant to pass through said slits at a flow speed having a magnitude sufficient to result in a heat transmission coefficient alpha between said internal plate and said coolant, that amounts to between 20 and 70 $Kw/m^2K$, said internal plate having a heat flow density that is larger than the heat flow density of a smooth internal plate having no ribs, and said internal plate and ribs comprised, at least in part, of copper.

2. A continuous casting mold arrangement as set forth in claim 1, wherein said heat transmission coefficient amounts to between 25 and 50 $kW/m^2K$.

3. A continuous casting mold as set forth in claim 1, wherein said slit width is between 3 and 7 mm and the ratio of said slit width to said rib width is 1:2 or less.

4. A continuous casting mold as claimed in claim 1, wherein said coolant channels are substantially parallel.

5. A continuous casting mold as claimed in claim 4, wherein said internal plate defines bores positioned, dimensioned and configured to threadingly engage clamping bolts, said bores being arranged in substantially parallel rows, said rows being substantially parallel to said coolant channels.

6. A continuous casting mold as claimed in claim 5, further comprising intermediate sleeves positioned, configured and dimensioned to be retained in said bores, said intermediate sleeves having internal threads.

7. A continuous casting mold as claimed in claim 6, further comprising clamping bolts matingly engaging said internal threads of said intermediate sleeves and securely fixing said internal plate with respect to said supporting wall of said mold side wall means, said clamping bolts configured, dimensioned, and positioned to cause rigid fastening between said internal plate and said supporting wall and prevent warping of said internal plate.

* * * * *